US007713085B2

(12) United States Patent
Wu et al.

(10) Patent No.: US 7,713,085 B2
(45) Date of Patent: May 11, 2010

(54) CONNECTOR INTERFACE

(75) Inventors: Hongbin Wu, Shenzhen (CN); Dong Yang, Shenzhen (CN); Wei Fang, Shenzhen (CN); Fengwei Tian, Shenzhen (CN); Facan Feng, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 681 days.

(21) Appl. No.: 11/357,642

(22) Filed: Feb. 17, 2006

(65) Prior Publication Data

US 2008/0132111 A1 Jun. 5, 2008

(30) Foreign Application Priority Data

Mar. 11, 2005 (CN) ..... 2005 2 0007642 U

(51) Int. Cl.
*H01R 13/60* (2006.01)

(52) U.S. Cl. ..... 439/541.5; 660/362

(58) Field of Classification Search ..... 439/541.5, 439/660, 607, 359, 362, 491
See application file for complete search history.

(56) References Cited

U.S. PATENT DOCUMENTS

| | | | | |
|---|---|---|---|---|
| 4,579,412 | A | 4/1986 | Czeschka et al. | |
| 4,843,714 | A | 7/1989 | Whiteman, Jr. | |
| 4,961,711 | A | 10/1990 | Fujiura et al. | |
| 5,171,161 | A | 12/1992 | Kachlic | |
| 5,955,703 | A | 9/1999 | Daly et al. | |
| 6,162,090 | A | 12/2000 | Klubenspies et al. | |
| 6,244,895 | B1 * | 6/2001 | Huang | 439/541.5 |
| 6,540,551 | B1 * | 4/2003 | Wang | 439/541.5 |
| 6,582,244 | B2 * | 6/2003 | Fogg et al. | 439/362 |
| 6,752,654 | B1 | 6/2004 | Huang et al. | |
| 2002/0058439 | A1 * | 5/2002 | Ewell et al. | 439/491 |
| 2002/0076977 | A1 * | 6/2002 | Sakamoto | 439/541.5 |
| 2002/0146926 | A1 | 10/2002 | Fogg et al. | |
| 2006/0199424 | A1 * | 9/2006 | Landis et al. | 439/491 |

FOREIGN PATENT DOCUMENTS

| | | | |
|---|---|---|---|
| CN | 2651994 | Y | 10/2004 |
| CN | 2664227 | Y | 12/2004 |
| DE | 201 06 297 | U1 | 8/2001 |
| EP | 1 624 535 | A1 | 2/2006 |

OTHER PUBLICATIONS

International Search Report from International Application No. PCT/CN2006/000366.
European Search Report from European Patent Application 06003040.

* cited by examiner

*Primary Examiner*—Hien Vu

(57) ABSTRACT

The present invention provides a connector interface comprising a connector socket interface and a connector plug interface, the connector socket interface comprising metal shell, insulator, band-shaped recess provided on said insulator and metal contacts and the connector plug interface comprising metal shell, insulator, and band-shaped protrusion provided on said insulator and metal contacts, said connector socket interface and said connector plug interface being able to be coupled together, wherein: said connector socket interface has a plurality of band-shaped recesses and said connector plug interface has a plurality of band-shaped protrusions. In a connector interface with the same number of metal pieces according to an embodiment of the present invention, the footprint of the coupling part is reduced, the footprint per pair of contacts is reduced, and the objective of increasing the pin density of the contacts in a connector is achieved.

18 Claims, 6 Drawing Sheets

CONNECTOR INTERFACE

FIELD OF THE INVENTION

The present invention relates to a connector, especially a connector interface.

BACKGROUND OF THE INVENTION

Connectors are important components in electronic devices for signal transmission. For example, in the field of ADSL (Asymmetric Digital Subscriber Line), DSLAMs (Digital Subscriber Line Amplitude Modules) provide subscriber line interfaces via connectors to implement connections between subscriber lines and equipment at the office end and thereby accomplish such functions as transmitting/receiving, encoding/decoding, bandwidth multiplexing, and system maintenance and management, etc., of ADSL subscriber lines.

A stereogram of connector interfaces at DSLAM side is shown in FIG. 1. The connector interface in FIG. 1 comprises a connector socket interface and a connector plug interface.

Both the connector socket interface and the connector plug interface comprise metal shell, plastic insulator and contacts. When the connector socket interface is coupled with the connector plug interface, the metal shell and the plastic insulator of the connector socket interface make plugging contact with the metal shell and the plastic insulator of the connector plug interface respectively, so as to implement the connector interface shielding; whereas the metal contacts of the connector socket interface make plugging contact with the metal contacts of the connector plug interface to implement signal transmission.

A stereogram of the connector socket interface is shown in FIG. 2; the front view of the connector socket interface is shown in FIG. 3.

As shown in FIG. 2 and FIG. 3, a longitudinal section of the part of the metal shell and the plastic insulator of the connector socket interface to be coupled with the connector plug interface is in isosceles trapezoid shape, and each of the four corners of the trapezoid is rounded respectively, like a inverted "D" shape. The center part of the plastic insulator of the connector socket interface appears as a band-shaped recess, and there are a number of slots evenly arranged on the upper and lower side walls of the recess. There is a metal contact of the connector socket interface in each of the slots, and the spacing between two adjacent contacts is 2.16 mm, i.e., 0.085". Fastening means are provided correspondingly in the metal shell and the plastic insulator of the connector socket interface, and are located near the centers of the bevel edges of the isosceles trapezoid respectively.

As described above, for example, in a connector socket interface with 64 contacts in a practical application, the connector socket interface is 98.43 mm (L)×15.37 mm (W), and then the footprint of every two contacts in the connector socket interface is 47.28 $mm^2$.

A stereogram of the connector plug interface is shown in FIG. 4; the front view of the connector plug interface is shown in FIG. 5.

As shown in FIG. 4 and FIG. 5, the longitudinal section of the part of the metal shell and the plastic insulator of the connector plug interface to be coupled with the connector socket interface is in isosceles trapezoid shape, and each of the four corners of the trapezoid is rounded, like a inverted "D" shape. The center part of the plastic insulator of connector plug interface appears as a band-shaped protrusion, and there are a number of slots evenly arranged on the upper and lower side walls of the protrusion. There is a metal contact of the connector plug interface in each of the slots, and the spacing between two adjacent contacts is 2.16 mm, i.e., 0.085". Fastening means are provided correspondingly in the metal shell and the plastic insulator of the connector plug interface, and located near the centers of the bevel edges of isosceles trapezoid respectively.

As described above, for example, in a connector interface with 64 contacts in practical application, the connector plug interface is 98.43 mm (L)×15.37 mm (W), and the footprint of every two contacts in the connector plug interface is 47.28 $mm^2$.

The footprint of the existing connector interface is large, and the pin density of the contacts in the connector interface is low.

SUMMARY OF THE INVENTION

An objective of the present invention is to provide a connector interface, so as to overcome the drawbacks in the prior art, such as large connector interface footprint and low pin density of the metal contacts.

To attain above objective, the present invention provides the following technical solution:

a connector interface comprising a connector socket interface and a connector plug interface; the connector socket interface comprising metal shell, insulator, band-shaped recess provided on said insulator and metal contacts, and the connector plug interface comprising metal shell, insulator, band-shaped protrusion provided on said insulator and metal contacts; said connector socket interface and said connector plug interface being able to be coupled together; wherein:

said connector socket interface has a plurality of band-shaped recesses, and there are a number of slots that accommodate the metal contacts of the connector socket interface provided on both the upper and lower side walls of each of the band-shaped recesses;

said connector plug interface has a plurality of band-shaped protrusions, corresponding to the plurality of band-shaped recesses on said connector socket interface, and there are a number of slots that accommodate the metal contacts of the connector plug interface provided on both the upper and lower side walls of each of said band-shaped protrusions.

Preferably, the plurality of band-shaped recesses are arranged in parallel to each other on the insulator of said connector socket interface;

the plurality of band-shaped protrusions are arranged in parallel to each other on the insulator of said connector plug interface, corresponding to said band-shaped recesses respectively.

Preferably, the plurality of band-shaped recesses on the insulator of said connector socket interface are different in length, and the band-shaped protrusions on the insulator of said connector plug interface correspond to said plurality of band-shaped recesses in length, respectively.

Preferably, the longitudinal sections of the parts of the metal shell and the insulator of said connector socket interface and the metal shell and the insulator of said connector plug interface to be coupled with each other are all in rectangular shape.

Preferably, the four corners of said rectangle are fillets.

Preferably, among said four fillets, the fillet radiuses of two fillets corresponding to the diagonal of the rectangle are different from each other.

Preferably, there are fasteners matching with each other provided on the metal shell, the insulator of said connector socket interface and the metal shell, the insulator of said connector plug interface, and, said fasteners are used for fastening when said connector socket interface is coupled with said connector plug interface.

Preferably, said fasteners include screws and nuts matching therewith;

said screws are provided at both the upper and lower sides of the diagonal extension lines of the longitudinal section of the part of said connector plug interface to be coupled with said connector socket interface;

said nuts are provided on said connector socket interface at positions corresponding to said screws.

Preferably, there are numerals labeled on the insulator of said connector socket interface at positions corresponding to the slots thereof;

there are numerals labeled on the insulator of said connector plug interface at positions corresponding to the slots thereof.

Preferably, there is at least one protrusion provided between the positions of the metal shell of said connector socket interface and the metal shell of said connector plug interface where they make plugging contact with each other; and said protrusion is provided on the outer wall of the metal shell of said connector plug interface at a position where the metal shell of said connector plug interface and the metal shell of said connector socket interface to be coupled with each other, or on the inner wall of the metal shell of said connector socket interface at a position where the metal shell of said connector socket interface and the metal shell of said connector plug interface to be coupled with each other.

Preferably, there are protrusions provided on the upper side and lower side of the insulator of said connector socket interface, and there are lugs provided on the metal shell of said connector socket interface, and said protrusions being blocked at said lugs, respectively.

It can be known from the description of the above technical solution, in the present invention, by arranging a plurality of band-shaped recesses on the insulator of a connector socket interface and a plurality of band-shaped protrusions corresponding to the respective recesses on the insulator of a connector plug interface, the footprint of the coupling part of the connector interface is reduced with the connector interface having same number of contacts; through the modifying of the longitudinal sections of the parts of the connector plug interface and the connector socket interface to be coupled with each other into a rectangular shape, the footprint of the coupling part of the connector interface is further reduced; through having fasteners, such as screws and nuts, on the connector interface arranged respectively at the upper side and the lower side of the diagonal extension line of the rectangle, the footprint of the coupling part of the connector interface is reduced effectively; with above arrangement, the footprint of each pair of contacts is reduced effectively; by such methods as providing different fillet radiuses for the rectangle, providing numeral labels on the insulator of connector interface, arranging the band-shaped recesses and the band-shaped protrusions of different length on the insulator, etc, the present invention is able to effectively prevent misplugging of connector interface; through providing protrusions located between the metal shells when the connector interfaces are coupled with each other, the connector interfaces can be connected tightly when coupled with each other; through providing protrusions and lugs on the metal shell and the insulator of the connector socket interface respectively, the metal shell of the connector socket interface can be coupled with the insulator tightly; as the result, the technical solution provided in the present invention attains the objective of increasing the pin density of the contacts of the connector and enhancing the retaining force of the connector interface.

DETAILED DESCRIPTION OF THE EMBODIMENTS

Figure 1:
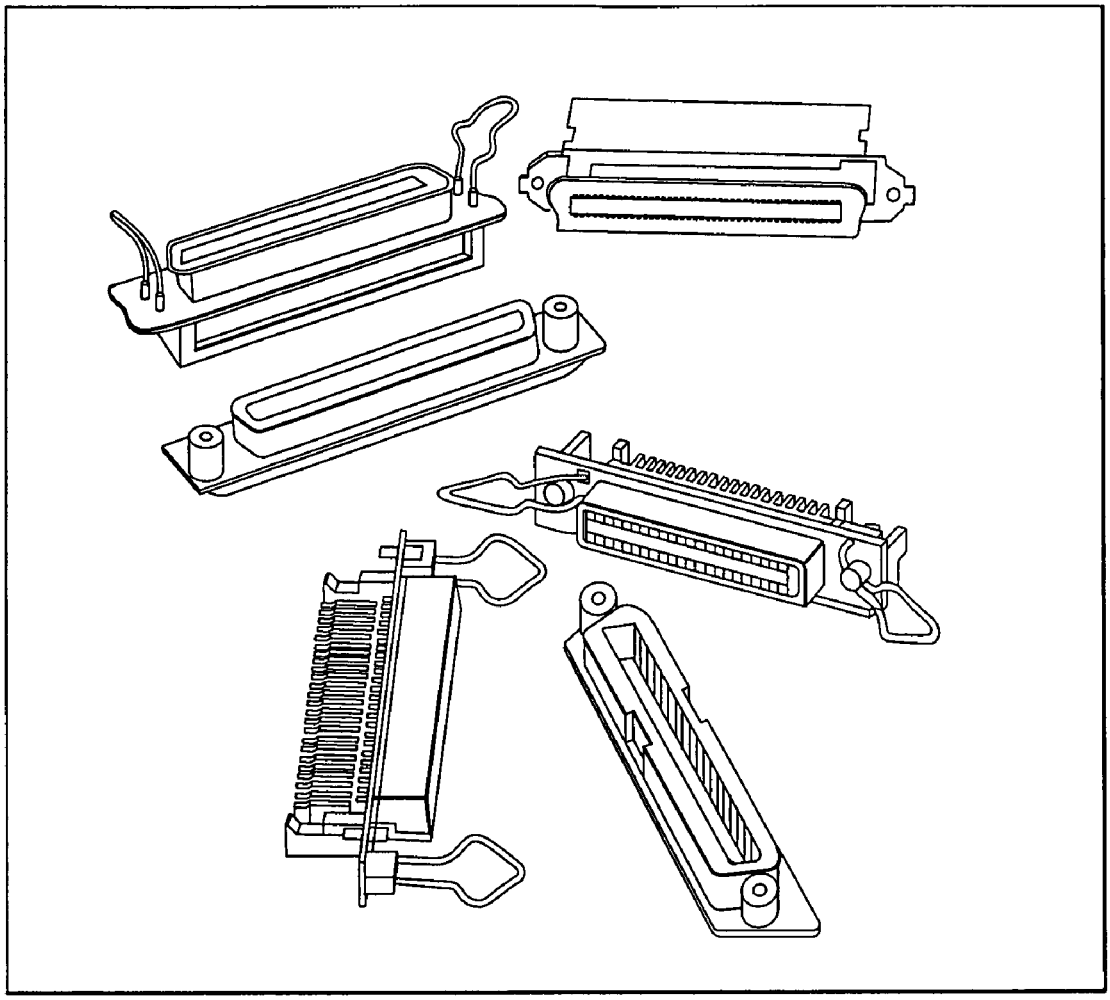
FIG. 1 (Prior Art)
FIG. 1 is a stereogram of connector interfaces in the prior art.
Figure 2:
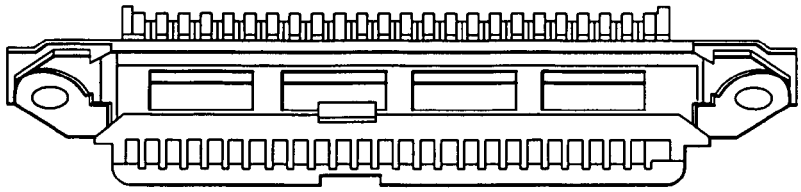
FIG. 2 (Prior Art)
FIG. 2 is a stereogram of a connector socket interface in the prior art.
Figure 3:
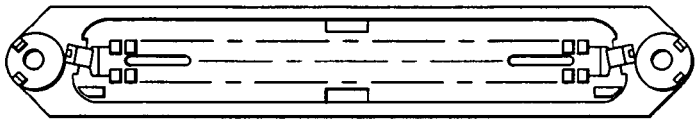
FIG. 3 (Prior Art)
FIG. 3 is a front view of the connector socket interface in the prior art.
Figure 4:
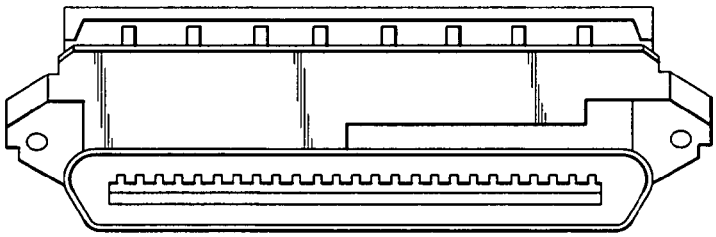
FIG. 4 (Prior Art)
FIG. 4 is a stereogram of a connector plug interface in the prior art.
Figure 5:
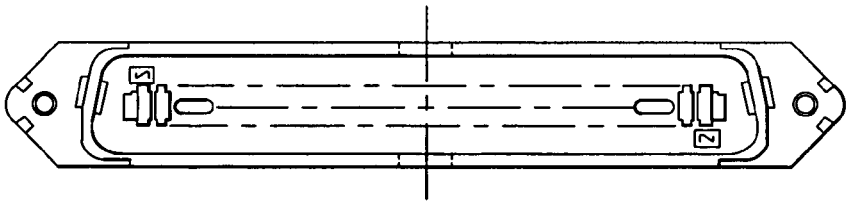
FIG. 5 (Prior Art)
FIG. 5 is a front view of the connector plug interface in the prior art.

In the present invention, there are a plurality of band-shaped recesses provided on the insulator of a connector socket interface, and there are a number of slots provided on both the upper and lower side walls of each band-shaped recess, for accommodating the metal contacts of the connector socket interface; there are a plurality of band-shaped protrusions provided on the insulator of a connector plug interface, corresponding to said band-shaped recesses respectively, and there are a number of slots provided on both the upper and lower side walls of each band-shaped protrusion, for accommodating the metal contacts of the connector plug interface.

The plurality of band-shaped recesses on the insulator of the connector socket interface can be arranged in parallel to each other, and the band-shaped recesses may be of equal or non-equal lengths; for example, if there are two band-shaped recesses provided on the insulator of the connector socket interface, the two band-shaped recesses can be of equal or non-equal lengths. If the individual band-shaped recesses are of non-equal lengths, misplugging of the connector interfaces can be effectively prevented. Likewise, the plurality of band-shaped protrusions on the insulator of the connector plug interface are also arranged in parallel, corresponding to the band-shaped recesses respectively, and the length of the band-shaped protrusion corresponds to that of the band-shaped recess respectively. When the band-shaped recesses are of non-equal lengths, they can be arranged symmetrically with reference to the center line of the coupling part of the connector socket interface; likewise, the band-shaped protrusions shall also be arranged symmetrically with reference to the center line of the coupling part of the connector plug interface.

With above configuration, the coupling part of the connector interface according to an embodiment of the present invention is slightly wider than that of a connector interface with the same number of contacts in the prior art; however, the coupling part of the connector interface according to an embodiment of the present invention is much shorter than that of the connector interface in the prior art, so that the longitudinal section area of the coupling part of the connector interface according to an embodiment of the present invention is reduced.

In order to further reduce the longitudinal section area of the coupling part of the connector interface, the longitudinal section of the coupling part of the connector interface is in rectangular shape, i.e., both of the longitudinal sections of the parts of the metal shell and the insulator of the connector socket interface and the metal shell and the insulator of the connector plug interface to be coupled with each other, respectively, are in rectangular shape.

All of the four corners of said rectangle are fillets, and among them, the fillet radiuses of the two fillets corresponding to the diagonal of the rectangle are different, effectively avoiding misplugging of the connector interfaces when coupled.

In the present invention, in order to ensure the connector socket interface be connected with the connector plug interface tightly, fasteners are provided on the connector interface, for example, screws are provided on the connector plug interface, and nuts matching with the screws are provided on the connector socket interface. The screws shall pass through the metal shell and the insulator of the connector plug interface, and, when the connector plug interface is coupled with the connector socket interface, are screwed up to the nuts on the connector socket interface, so that the connector interfaces are connected tightly in the plugging direction.

There are usually two screws; in order to reduce the footprint of the coupling part of the connector interface, said two screws can be provided at the upper and lower sides of the diagonal extension line of the coupling part of the connector plug interface, and the nuts on the connector socket interfaces are arranged at positions corresponding to those of the screws.

To ensure the connector socket interface be connected tightly with the connector plug interface in a direction other than the plugging direction, in the present invention, at least one protrusion is provided between the metal shells of the coupling parts of the connector interfaces; said protrusion can be in semispherical shape and can be provided on the inner wall of the coupling part of metal shell of the connector socket interface; likewise, the protrusion can also be provided on the outer wall of the coupling part of metal shell of the connector plug interface.

To provide further means against misplugging when the connector interfaces are coupled, in the present invention, numerals can be labeled on the insulators of the connector socket interface and of the connector plug interface respectively; for example, numerals can be labeled beside the respective slots on the insulator of the connector socket interface in order of the positions of the metal contacts, and numerals can be labeled beside the respective slots on the insulator of the connector plug interface in order of the positions of the metal contacts, the numerals labeled on the insulator of the connector plug interface should correspond to the numerals labeled on the insulator of the connector socket interface; in this way, when the connector interfaces are coupled, whether the connector interfaces are coupled correctly can be judged by the corresponding numerals on the connector socket interface and the connector plug interface, even without the difference in fillet radius or the difference in length of the band-shaped recess.

To ensure the metal shell of the connector socket interface be connected tightly with the insulator of the connector socket interface and easy to disassemble, in the present invention, protrusions are provided on both the upper side and lower side of the base at the coupling part of the insulator of the connector socket interface; said protrusions can be 4 in number, two on each side. The protrusions can be in a wedge shape. Lugs of the same number are provided correspondingly on the metal shell of the connector socket interface, and, when the metal shell of the connector socket interface is connected with the insulator of the connector socket interface, the lugs are blocked at the wedge-shaped protrusions respectively.

Hereunder the structure of the connector interface provided in an embodiment of the present invention is described in detail with reference to the attached drawings.

Figure 6:
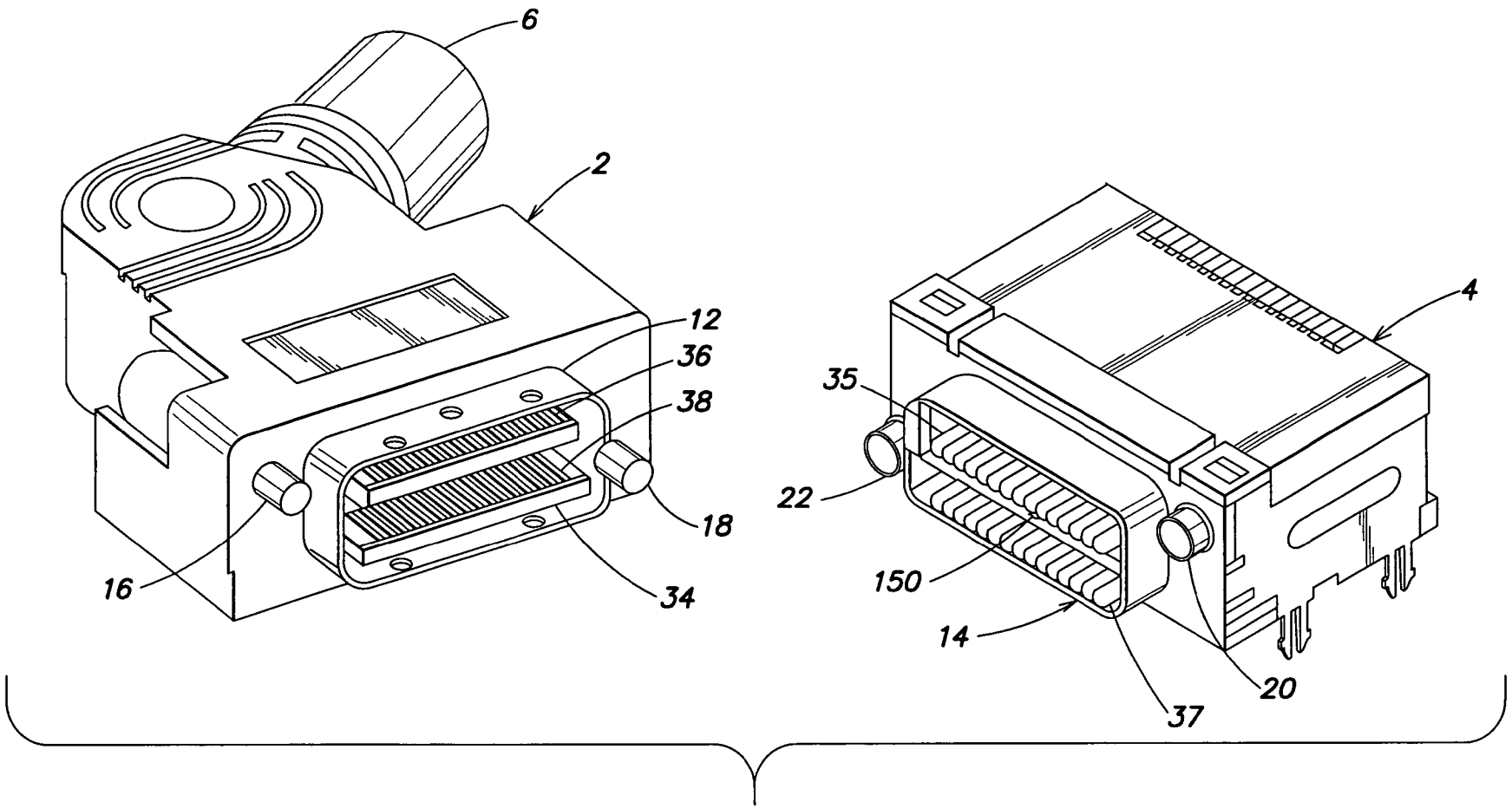
FIG. 6 is a stereogram of a connector with a connector interface according to an embodiment of the present invention.

A stereogram of a connector with a connector interface according to an embodiment of the present invention is shown in FIG. 6.

In FIG. 6, the left view shows the connector side with connector plug interface 2; the right view shows the connector side with connector socket interface 4. The connector interface according to an embodiment of the present invention comprises connector socket interface 4 and connector plug interface 2. The connector plug interface 2 is connected with data cable 6 of multiple twisted pair of the connector; and the connector socket interface 4 is connected with the Printed Circuit Board in electronic equipment, such as DSLAM.

The connector plug interface 2 mainly comprises metal shell 12 of the connector plug interface, insulator 34 of the connector plug interface, metal contacts 36, 38 and fixing screws 16, 18 of the connector plug interface.

The connector plug interface 4 mainly comprises metal shell 14 of the connector socket interface, insulator 150 of the connector socket interface, metal contacts 35, 37 and fixing nuts 20, 22 of the connector socket interface.

The connector plug interface 2 and the connector socket interface 4 are fully shielded when coupled with each other; interface shielding of the connector plug interface 2 is achieved by its metal shell 12, and interface shielding of the connector socket interface 4 is achieved by its metal shell 14. When the connector plug interface 2 and the connector socket interface 4 are coupled with each other, the metal shell 12 and the metal shell 14 are connected with each other, achieving full shielding of the connector interface.

Figure 7:
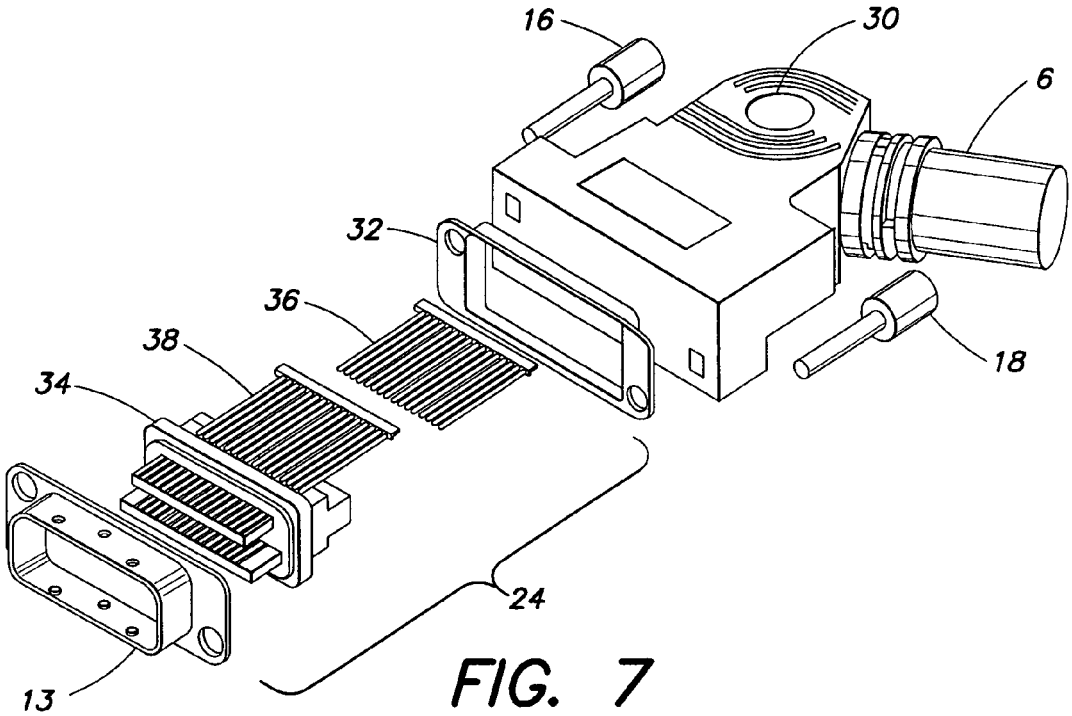
FIG. 7 is a stereogram of a connector plug interface according to an embodiment of the present invention.

A stereogram of a connector plug interface according to an embodiment of the present invention is shown in FIG. 7.

As shown in FIG. 7, the body 24 of the connector plug interface mainly comprises front metal shell 13 of the connector plug interface, rear metal shell 32 of the connector plug interface, insulator 34 of the connector plug interface, metal contacts 36, 38 of the connector plug interface, and screws 16, 18 of the connector plug interface.

The front metal shell 13 and the rear metal shell 32 together form the metal shell 12 of the connector plug interface shown in FIG. 6.

As can be seen from FIG. 7, there are two band-shaped protrusions 204, 206 provided on the insulator 34 of the connector plug interface, the band-shaped protrusions 204, 206 being in parallel to each other, and the two band-shaped protrusions 204, 206 are different in length.

Figure 8:
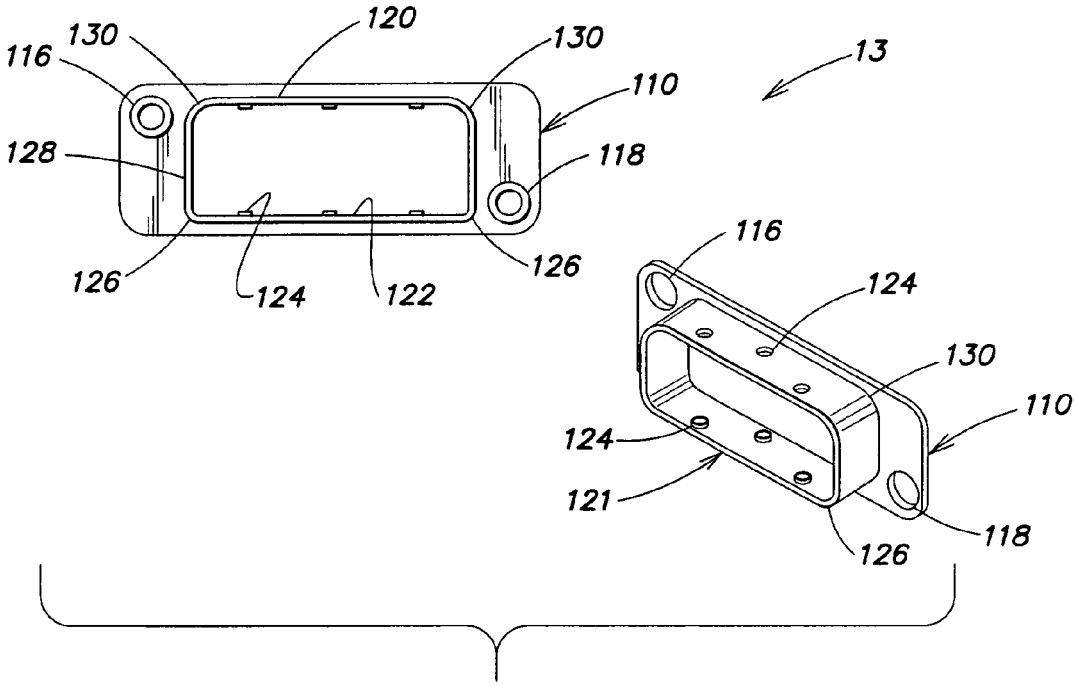
FIG. 8 is a front view of the front metal shell of the connector plug interface according to an embodiment of the present invention.

A stereogram and a front view of front metal shell 13 of the connector plug interface are shown in FIG. 8.

In FIG. 8, the left view is the front view of the front metal shell 13; the right view is the stereogram of the front metal shell 13.

The front metal shell 13 mainly comprises base 110 of the metal shell and coupling part 121 of the metal shell. The coupling part 121 of the metal shell is formed on the base 110 of the metal shell by punching, and the coupling part 121 of the metal shell is punched into a rectangle, comprising two longitudinal side walls 120 and two lateral side walls 128. The longitudinal side wall 120 and the lateral side walls 128 are connected with each other via a large fillet 130 and a small fillet 126. The fillet radius of the large fillet 130 is different from that of the small fillet 126.

As the large fillet 130 and the small fillet 126 cause the longitudinal section of the coupling part 121 i.e., shielding shell 121, of metal shell of the connector plug interface to be asymmetric with reference to the horizontal center line, misplugging of the connector interface when coupled is prevented effectively.

A plurality of circle protrusions 124 are provided on the inner walls 122 of the two longitudinal side wall 120, to ensure a certain retaining force in a direction other than the plugging direction when the connector plug interface the connector socket interface are coupled with each other, so that the connector plug interface and the connector socket interface are connected tightly with each other.

Two screw holes 116, 118 corresponding to the screws are punched on the base 110 of the metal shell. The screw holes 116 and 118 are provided at two sides of the diagonal extension line of the rectangular longitudinal section of the coupling part 121 of the metal shell. The screw holes 116 and 118 are of the same size, and larger than the diameter of the screws.

Figure 9:
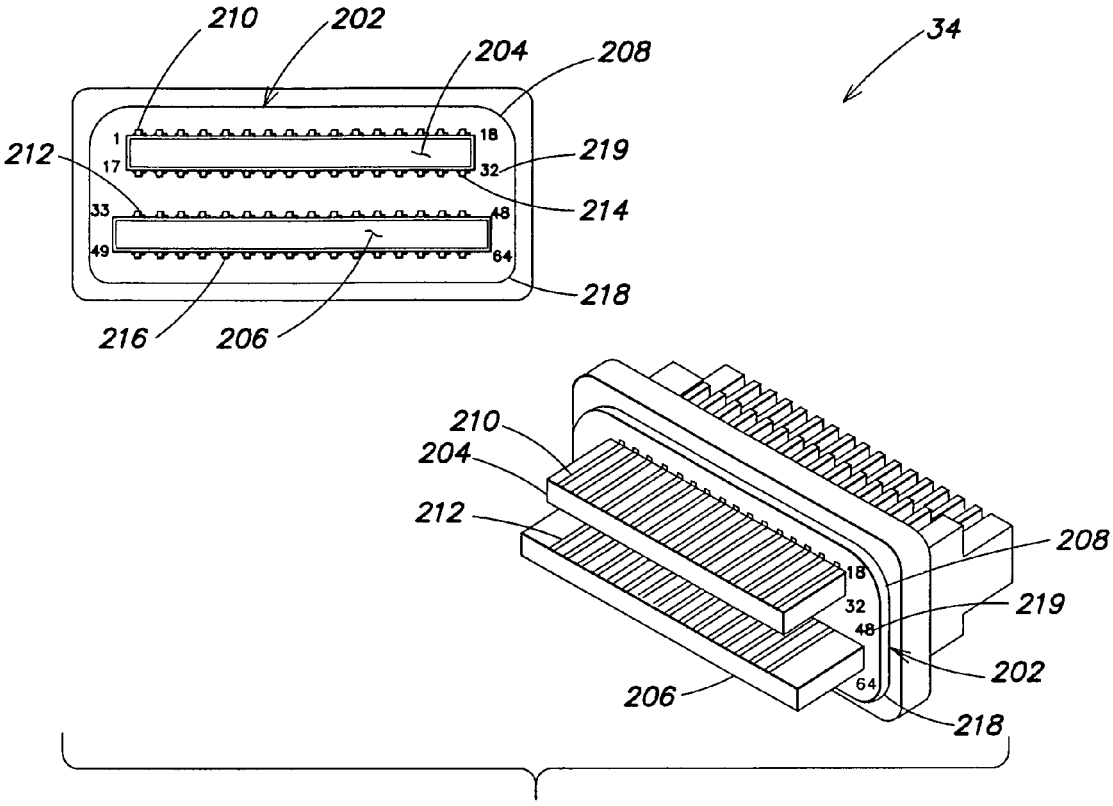
FIG. 9 is a stereogram and a front view of the insulator of the connector plug interface according to an embodiment of the present invention.

A stereogram and a front view of the insulator 34 of the connector plug interface are shown in FIG. 9.

In FIG. 9, the left view is the front view of the insulator 34; the right view is the stereogram of the insulator 34.

The insulator 34 of the connector plug interface shown in FIG. 9 can be made through injection molding. There are an upper band-shaped protrusion 204 and a lower band-shaped protrusion 206 in parallel to each other provided on the insulator 34. There are a plurality of slots 210 and 214 provided on the upper and lower sides of the upper band-shaped protrusion 204, respectively, to accommodate a plurality of metal contacts of the connector plug interface. There are a plurality of slots 212 and 216 provided on the upper and lower sides of the lower band-shaped protrusion 206, respectively, to accommodate a plurality of metal contacts of the connector plug interface. The longitudinal section of the base 202 of the upper and lower band-shaped protrusions 204 and 206 is in rectangular shape, and the four corners of the rectangle are fillets 208 and 218; the fillets 208 and 218 of the base 202 correspond to the large fillet 130 and the small fillet 126 of the front metal shell of the connector plug interface, respectively, i.e., the radius of the large fillet 208 is different from that of the small fillet 218, and the large fillet 208 and the small fillet 218 are asymmetrical in reference to the horizontal center line of the longitudinal section of the coupling part of insulator 34 of the connector plug interface.

There are numerals 219 provided on the base 202 of the insulator 34 of the connector plug interface, and these numerals may indicate positions of the individual metal contacts of the connector plug interface.

Figure 10:
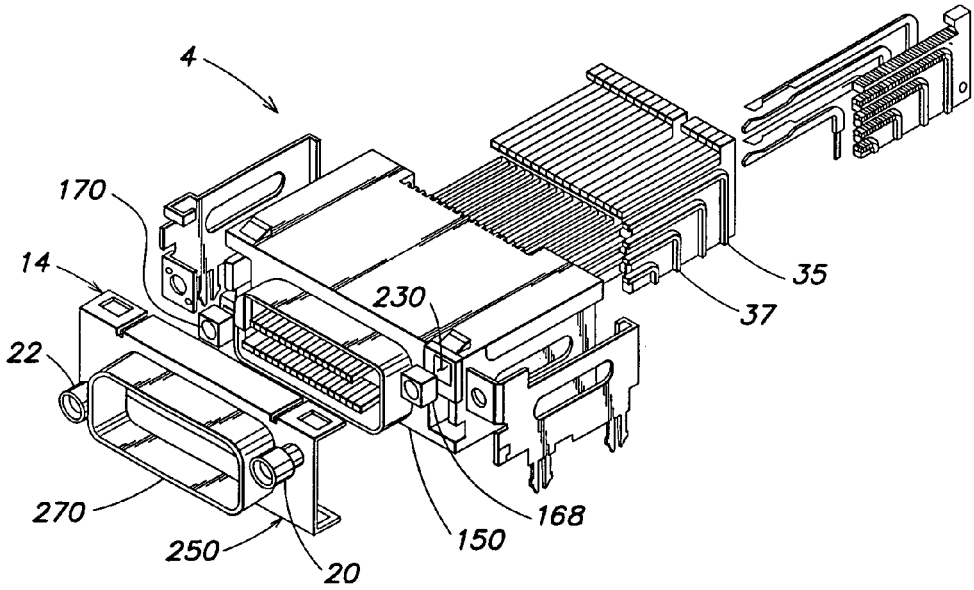
FIG. 10 is a stereogram of a connector socket interface according to an embodiment of the present invention.

A stereogram of a connector socket interface is shown in FIG. 10.

As shown in FIG. 10, the connector socket interface 4 provided in an embodiment of the present invention mainly comprises metal shell 14 of the connector socket interface, insulator 150 of the connector socket interface, fixing nuts 20, 22 of the connector socket interface, and metal contacts 35, 37 of the connector socket interface.

The external thread portion of fixing nuts 20, 22 are connected with the fixing nuts 168, 170 having internal thread portion on the insulator 150; the fixing nuts 168, 170 can be of square shape in profile, and embedded into the insulator 150 at corresponding positions, there are two square holes 230 corresponding to the fixing nuts 168, 170 respectively, for embedding the fixing nuts 168, 170 provided at the corresponding positions of the insulator 150.

Figure 11:
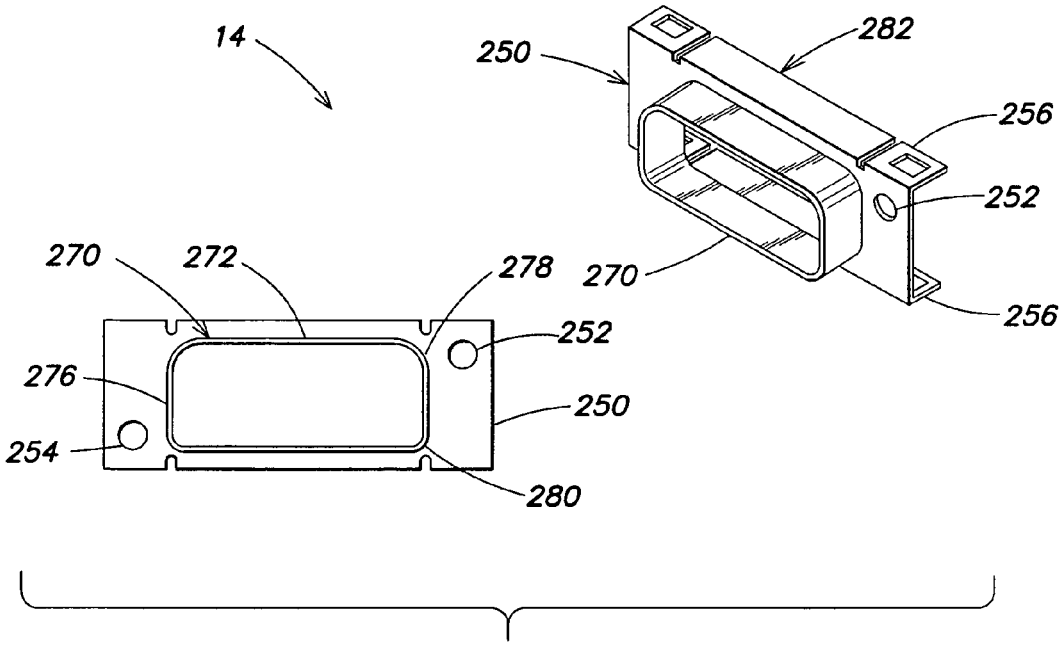
FIG. 11 is a stereogram and a front view of the metal shell of the connector socket interface according to an embodiment of the present invention.

A stereogram and a front view of the metal shell 14 of the connector socket interface are shown in FIG. 11.

In FIG. 11, the left view is the front view of metal shell 14; the right view is the stereogram of metal shell 14.

Coupling part 270 of the metal shell 14 is formed on base 250 of the metal shell by punching, and the coupling part 270 of the metal shell is punched into a rectangle, comprising two longitudinal side walls 272 and two lateral side walls 276. The longitudinal side walls 272 and the lateral side walls 276 are connected with each other via two large fillets 278 and two small fillets 280 respectively. The radius of the large fillet 278 is different from that of the small fillet 280, and the large fillet 278 and the small fillet 280 are asymmetrical in reference to the horizontal center line of the longitudinal section of the metal shell 14 of the connector socket interface, effectively preventing misplugging of the connector interface when coupled.

Two screw holes 252, 254 corresponding to the screws are also punched on the base 250 of the metal shell. The screw holes 252 and 254 are provided at two sides of the diagonal extension line of the rectangular longitudinal section of the coupling part 270 of the metal shell 14. The screw holes 252 and 254 are of the same size, and larger than the diameter of the screws 16 and 18.

There are two flanged edges 282 on side of the two longitudinal side walls of the base 250 of the metal shell 14, with two lugs 256 provided on the two flanged edges 282 respectively, for connecting with the wedge-shaped protrusions on the plastic insulator of the connector socket interface.

Figure 12:
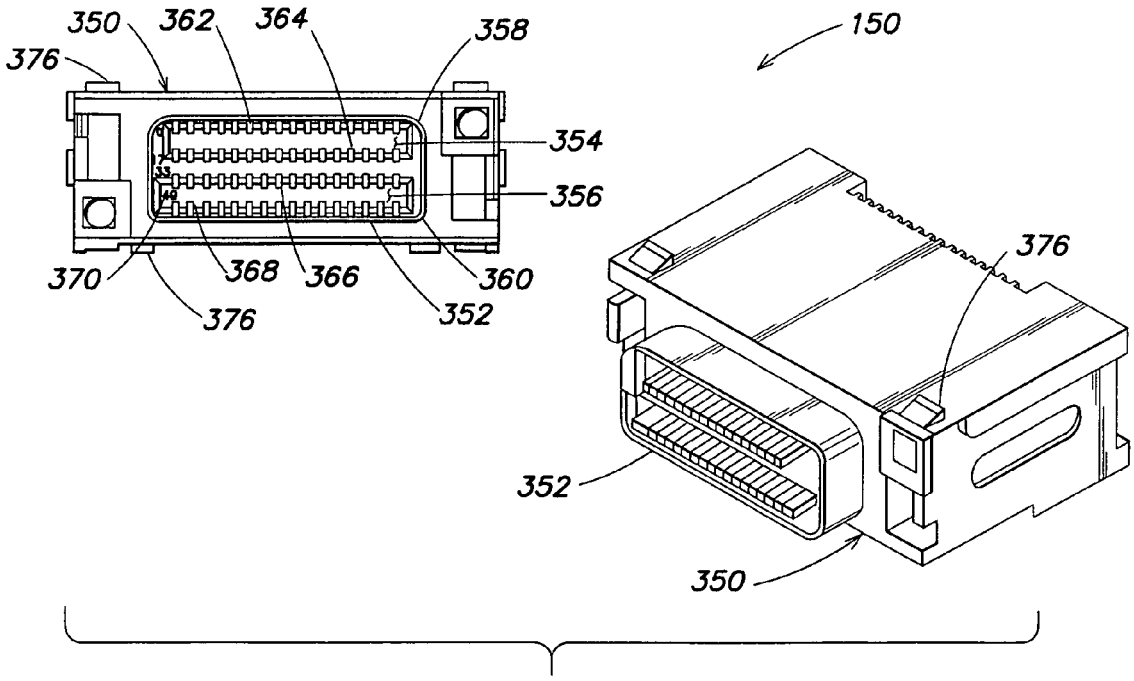
FIG. 12 is a stereogram and a front view of the insulator of the connector socket interface according to an embodiment of the present invention.

A stereogram and a front view of the insulator 150 of the connector socket interface are shown in FIG. 12.

In FIG. 12, the left view is the front view of insulator 150; the right view is the stereogram of insulator 150.

The insulator 150 of the connector socket interface can be made through injection molding. The insulator 150 comprises base 350 of the insulator and rectangular protrusion 352; the rectangular protrusion 352 is the coupling part of the insulator 150 of the connector socket interface. There is an upper band-shaped recess 354 and a lower band-shaped recess 356 in parallel to each other provided on the rectangular protrusion 352. There are a plurality of slots 362 and 364 provided on the upper and lower sides of the upper band-shaped recess 354, respectively, to accommodate a plurality of metal contacts of the connector socket interface. There are a plurality of slots 366 and 368 provided on the upper and lower sides of the lower band-shaped recess 356, respectively, to accommodate a plurality of metal contacts of the connector socket interface. The longitudinal section of the rectangular protrusion 352 with the upper and lower band-shaped protrusions 354 and 256 is in rectangular shape, and the four corners of the rectangle are fillets 358 and 360, the fillets 358 and 360 corresponding to the large fillet 130 and the small fillet 126 of the front metal shell of the connector plug interface, respectively, i.e., the radius of the large fillet 358 is different from that of the small fillet 360, so that the coupling part of the insulator 150 of the connector socket interface is asymmetrical in reference to the horizontal center line.

There are numerals 370 provided on the coupling part 352 of the insulator 150 of the connector socket interface, and these numerals 370 may indicate positions of the individual metal contacts of the connector socket interface.

There are wedge-shaped protrusions 376 corresponding to the lugs 256 on the flanged edges 282, provided on side of the two longitudinal side walls of the base 350 of the insulator 150 of the connector socket interface, blocked at the lugs 256 respectively, so that the metal shell 14 of the connector socket is tightly connected with the plastic insulator 150.

In a connector interface with 64 contacts in practical application, for example, both the connector socket interface and the connector plug interface according to an embodiment of the present invention are 38 mm (L)×14.6 mm (W), then longitudinal section areas of the connector socket interface and the connector plug interface are 554.8 $mm^2$, which is only ⅓ of the longitudinal section area of a connector interface in the prior art, 1512.9 $mm^2$; the footprint of each pair of contacts of the connector interface according to an embodiment of the present invention is 16.27 $mm^2$, and the pin density is almost 3 times of that of a connector interface in the prior art. In the present invention, the volume of the electronic equipment is reduced significantly through increasing the pin density of the connector interface, thereby making the electronic equipment have a trend to miniature and high density.

Though the present invention is described through the embodiments, those skilled in the art should understand that many modifications and variations can be made to the present invention, without departing from the spirit of the present invention; such modifications and variations to the present invention fall into the scope of the present invention as defined in the claims.

The invention claimed is:

1. A connector interface comprising a connector socket interface and a connector plug interface, the connector socket interface comprising a socket metal shell, a socket insulator housing, at least first and second band-shaped recesses provided in said socket insulator housing, socket metal contacts, and an insulator socket cover for covering the socket metal shell and socket insulator housing; and the connector plug interface comprising front and rear metal shells, a plug insulator housing, at least first and second band-shaped protrusions provided in said plug insulator housing, plug metal contacts, and an insulator plug cover for covering the front and rear metal shells and the plug insulator housing, said connector socket interface and said connector plug interface being able to be coupled together, wherein:

said band-shaped recesses have a plurality of slots that accommodate the metal contacts of the connector socket interface provided on upper and lower walls of each of the band-shaped recesses;

said connector plug interface has the at least first and second band-shaped protrusions corresponding to the at least first and second band-shaped recesses on said connector socket interface, and there are a plurality of slots on the band-shaped protrusions that accommodate the metal contacts of the connector plug interface provided on both the upper and lower walls of each of said band-shaped protrusions; and the at least first and second band-shaped recesses in the insulator housing of said connector socket interface being different in length from each other, the first band-shaped recess being shorter than the second band-shaped recess and the at least first and second band-shaped protrusions of the insulator housing of said connector plug interface correspond to said at least first and second band-shaped recesses being different in length, respectively, the metal contacts of the socket and plug being vertically aligned.

2. The connector interface according to claim 1, wherein:

there are numerals labeled on the insulator of said connector socket interface at positions corresponding to the slots thereof;

there are numerals labeled on the insulator of said connector plug interface at positions corresponding to the slots thereof.

3. The connector interface according to claim 1, wherein:

there is at least one protrusion provided between the positions of the metal shell of said connector socket interface and the metal shell of said connector plug interface where they make plugging contact with each other; and said protrusion is provided on the outer wall of the metal shell of said connector plug interface at a position where the metal shell of said connector plug interface and the metal shell of said connector socket interface are to be coupled with each other, or on the inner wall of the metal shell of said connector socket interface at a position where the metal shell of said connector socket interface and the metal shell of said connector plug interface are to be coupled with each other.

4. The connector interface according to claim 1, wherein:

there are protrusions provided on the upper side and lower side of the insulator of said connector socket interface, and there are lugs provided on the metal shell of said connector socket interface, said protrusions being blocked at said lugs, respectively.

5. The connector interface according to claim 1, wherein:

the plurality of band-shaped recesses are arranged in parallel to each other on the insulator of said connector socket interface;

the plurality of band-shaped protrusions are arranged in parallel to each other on the insulator of said connector plug interface, corresponding to said band-shaped recesses respectively.

6. The connector interface according to claim 5, wherein:

there are fasteners matching with each other provided on the metal shell and the insulator of said connector socket interface and the metal shell and the insulator of said connector plug interface, and said fasteners are used for fastening when said connector socket interface is coupled with said connector plug interface.

7. The connector interface according to claim 5, wherein:

there are numerals labeled on the insulator housing of said connector socket interface at positions corresponding to the slots thereof;

there are numerals labeled on the insulator housing of said connector plug interface at positions corresponding to the slots thereof.

8. The connector interface according to claim 5, wherein:

there is at least one protrusion provided between the positions of the metal shell of said connector socket interface and the metal shell of said connector plug interface where they make plugging contact with each other; and said protrusion is provided on the outer wall of the metal shell of said connector plug interface at a position where the metal shell of said connector plug interface and the metal shell of said connector socket interface are to be coupled with each other, or on the inner wall of the metal shell of said connector socket interface at a position where the metal shell of said connector socket interface and the metal shell of said connector plug interface are to be coupled with each other.

9. The connector interface according to claim 5, wherein:

there are protrusions provided on the upper side and lower side of the insulator of said connector socket interface, and there are lugs provided on the metal shell of said connector socket interface, said protrusions being blocked at said lugs, respectively.

10. The connector interface according to claim 1, wherein:

the longitudinal sections of the parts of the metal shell and the insulator of said connector socket interface, and the metal shell and the insulator of said connector plug interface to be coupled with each other, are all rectangular in shape.

11. The connector interface according to claim 10, wherein:

there are fasteners matching with each other provided on the metal shell and the insulator housing of said connector socket interface and the metal shell and the insulator housing of said connector plug interface, and said fasteners are used for fastening when said connector socket interface is coupled with said connector plug interface.

12. The connector interface according to claim 10, wherein:

there are numerals labeled on the insulator housing of said connector socket interface at positions corresponding to the slots thereof;

there are numerals labeled on the insulator housing of said connector plug interface at positions corresponding to the slots thereof.

13. The connector interface according to claim 10, wherein:

there is at least one protrusion provided between the positions of the metal shell of said connector socket interface and the metal shell of said connector plug interface where they make plugging contact with each other; and said protrusion is provided on the outer wall of the metal shell of said connector plug interface at a position where the metal shell of said connector plug interface and the metal shell of said connector socket interface are to be coupled with each other, or on the inner wall of the metal shell of said connector socket interface at a position where the metal shell of said connector socket interface and the metal shell of said connector plug interface are to be coupled with each other.

14. The connector interface according to claim 10, wherein:

there are protrusions provided on the upper side and lower side of the insulator of said connector socket interface, and there are lugs provided on the metal shell of said connector socket interface, said protrusions being blocked at said lugs, respectively.

15. The connector interface according to claim 10, wherein:

the four comers of said rectangle are fillets.

16. The connector interface according to claim 15, wherein:

among said four fillets, the fillet radiuses of two fillets corresponding to the diagonal of the rectangle are different from each other.

17. The connector interface according to claim 1, wherein:

there are fasteners matching with each other provided on the metal shell, the insulator housing of said connector socket interface and the metal shell, the insulator housing of said connector plug interface, and said fasteners are used for fastening when said connector socket interface is coupled with said connector plug interface.

18. The connector interface according to claim 17, wherein:

said fasteners include screws and nuts matching therewith;

said screws are provided at both the upper and lower sides of the diagonal extension lines of the longitudinal section of the part of said connector plug interface to be coupled with said connector socket interface;

said nuts are provided on said connector socket interface at positions corresponding to said screws.

* * * * *